United States Patent [19]

Kaley et al.

[11] Patent Number: 4,951,389

[45] Date of Patent: Aug. 28, 1990

[54] METHOD FOR MAKING A WIRE BARREL TERMINAL

[75] Inventors: Robert C. Kaley, Landisville; James H. Wise, Palmyra, both of Pa.

[73] Assignee: AMP Incorporated, Harrisburg, Pa.

[21] Appl. No.: 359,196

[22] Filed: May 31, 1989

[51] Int. Cl.[5] ..... H01R 4/20

[52] U.S. Cl. ..... 29/863; 439/882

[58] Field of Search ..... 29/863–866; 439/856, 857, 865–868, 877–882

[56] References Cited

U.S. PATENT DOCUMENTS

| | | |
|---|---|---|
| 2,535,013 | 3/1946 | Freedom . |
| 2,704,358 | 3/1955 | Wells . |
| 3,295,094 | 12/1966 | De Lyon . |
| 3,521,224 | 7/1970 | Spooren . |
| 3,538,239 | 11/1970 | Renshaw Jr. . |
| 3,699,504 | 10/1972 | Huber . |
| 4,142,771 | 3/1979 | Barnes et al. . |
| 4,150,355 | 4/1979 | Neff et al. . |
| 4,371,229 | 2/1983 | Spangler et al. . |
| 4,692,122 | 9/1987 | Montalbano . |

*Primary Examiner*—Gary F. Paumen

*Attorney, Agent, or Firm*—Katherine A. Nelson

[57] ABSTRACT

A method is disclosed for making a wire-receiving barrel terminal having a barrel with a desired inner diameter comprising the steps of: selecting a metal stock having the desired properties; stamping a terminal blank 12 having a forward portion 14 adapted to be formed into at least one contact section, an intermediate portion 16 extending rearwardly from said forward portion 14 and a rearward portion 18 adapted to be formed into first and second barrel sections 20, 32. The second barrel section 32 of said rearward portion is joined integrally with and extends rearwardly from said intermediate portion 16 and the first barrel section 20 is joined integrally with and extends from the second barrel section 32. The first and second barrel sections 20, 32 are generally rectangular and each has at least one lateral edge, and a lateral dimension equal to the circumference of a circle of desired wire receiving barrel inner diameter. In one embodiment first barrel section 20 is laterally offset from second barrel section 32 by bight section 42. A seamed barrel shaped member 44 is formed from first barrel section 20. Seamed outer barrel member 50 from second contact section 32 is formed around barrel-shaped member 44 after disposition thereof along a major surface of second barrel section 5 by bending at bight section 42. The seams 46, 52 of barrel terminal member 58 are essentially diametrically opposed and a continuous portion of the outer barrel member 50 overlies the inner slam 46. In another embodiment, a spiral double walled barrel 158 is formed by rolling, rearward portion 118 into barrel 158 having lateral edges 60, 62 thereof along a continuous wall portion.

6 Claims, 3 Drawing Sheets

METHOD FOR MAKING A WIRE BARREL TERMINAL

FIELD OF THE INVENTION

This invention is directed to electrical contact terminals and in particular to a method for making wire-receiving barrel type electrical terminals.

BACKGROUND OF THE INVENTION

In forming power or signal distribution systems it is necessary to provide interconnection between various members or components of the system. Generally the interconnections are provided by electrical connectors having one or more electrical contact terminals therein. Frequently the electrical terminals will be of the barrel type for termination to wire conductors. Generally it is desirable that these barrel terminals be crimpable to their associated wires. Furthermore, it is also desirable that the terminals be made in a cost effective manner such as by stamping and forming. Having an "open" seam in a barrel, however, can cause problems associated with stress relaxation in that when the terminal is crimped, the forces exerted outwardly along the seam of the crimped terminal may cause the seam to open, thus increasing the electrical resistance through the termination.

U.S. Pat. No. 2,535,013 discloses a connector having a crimpable power contact terminal having a solid barrel portion made by brazing the seam of a formed member. Other methods for achieving essentially solid barrel terminals include the use of a separate sleeve disposed over the formed terminal or by use of a machined part. Both of these aforementioned methods increase the number of manufacturing steps and, therefore, the cost of the terminal.

U.S. Pat. No. 2,535,013 discloses a method of crimping barrel type terminals that is designed to be used with a single annular ring such as a solid screw machined part or a formed member having a brazed seam. When the barrel is crimped it is subjected to sufficient pressure that the outer surface undergoes plastic deformation and is essentially locked into place and, therefore, does not stress relax enough to effect the function of the crimped barrel.

This application is related to U.S. application Ser. No. 07/285,681 filed Dec. 15, 1988, now abandoned and continued in U.S. Ser. No. 376,978 and owned by the present assignee, which discloses an electrical contact terminal comprised of a hollow body portion having a plurality of contacts sections extending forwardly therefrom, a double layer wire barrel portion and first and second opposing transition portions that extend between the barrel portions and the body portions. The double barrel portion includes inner and outer barrel sections, the first barrel section being nested within the second barrel portion such that a seam of the first barrel section is basically diametrically opposed from the seam of the second barrel section. The double barrel portion, therefore, simulates a continuous annular body that will act in essence as a solid member for crimping without requiring brazing or joining of the seam or a separate solid sleeve member disposed over the seam.

The method of making the above terminal is particularly suitable for electrical terminals having hollow body portions. It is also desirable, however, to have a double barrel portion for a ring type terminal or other electrical terminal having only a single transition portion between the barrel and the terminal wherein the double barrel portion can be crimped and act in essence as a solid member as previously described.

SUMMARY OF THE INVENTION

In accordance with the present invention a method is disclosed for making an electrical terminal is disclosed that alleviates disadvantages and deficiency of the prior art, can be stamped from a sheet of stock metal, and furthermore provides a double barrel sleeve portion that is crimpable.

It is an object of the invention to provide a means for making a terminal that has a barrel portion that is stamped and formed but has a construction that is essentially equivalent to that of a solid barrel member.

It is an additional object of the invention to provide an electrical terminal member that effectively has no open seam.

It is also object of the invention to provide a cost effective method for making electrical contact terminals having a crimpable barrel section.

Accordingly, the present invention is directed to a method for making a wire-receiving barrel type terminal comprising the steps of: selecting a metal stock having the desired properties; stamping a terminal blank having a forward portion adapted to be formed into at least one contact section, an intermediate portion extending rearwardly from the forward portion and a rearward portion adapted to be formed into first and second barrel sections; forming a first barrel section into a barrel shaped member; disposing the barrel shaped member along an adjacent major surface of the second barrel section and forming the second barrel section into an outer barrel member to extend circumferentially around the adjacent surface of the first barrel member such that a continuous portion of one of the barrel members is associated and overlies or underlies at least one of the lateral edges of the other barrel member.

In a first embodiment, the first and second barrel sections of the rearward portion are initially rectangular plates. The second barrel portion has opposed lateral edges and a rearward edge and is integrally joined with and extends rearwardly from the intermediate portion of the terminal blank. The first barrel section has opposed lateral edges and opposed forward and rearward edges and is joined integrally with and extends rearwardly from the rearward edge of the second barrel section at a bight section, the first barrel section being substantially offset from the second barrel section. After forming the first barrel section into a barrel shaped member having lateral edges thereof abutting at a first seam, the member is disposed along an adjacent and major surface of the second barrel section by bending at the bight section such that the first seam is disposed intermediate the lateral edges of the second barrel section. The second barrel section is then formed into an outer member to extend circumferentially around and adjacent the outer surfaces of the barrel shaped member with the lateral edges of the outer member abutting at a second seam that is essentially diametrically opposed from the first seam.

In a second embodiment the rearward portion of the terminal blank is a continuous strip extending outwardly from the intermediate portion. The first barrel section is joined integrally with and extends laterally from the second barrel section. The first and second barrel sections are generally rectangular and conclude in respective first and second lateral edges. The first barrel section has a lateral dimension essentially equal to the circumference of a circle of the desired wire-receiving barrel inner diameter. The second barrel section has a lateral dimension essentially equal to the intended outer circumference of the desired barrel. First barrel section is formed into a barrel-shaped member by rolling with the first lateral edge of the first barrel section disposed adjacent a surface of the second barrel section and the barrel-shaped member having its axis parallel to the first lateral edge. The second barrel section is formed circumferentially around and adjacent the first barrel section defining a spiral wire-receiving barrel having inner and outer walls. The forming steps are defined by the locating of the first and second lateral edges along a continuous wall portion of the spiral wire receiving barrel. The resulting barrel has substantially two wall thickness circumferentially therearound and no open seam.

DETAILED DESCRIPTION OF THE DRAWINGS

Figure 1:
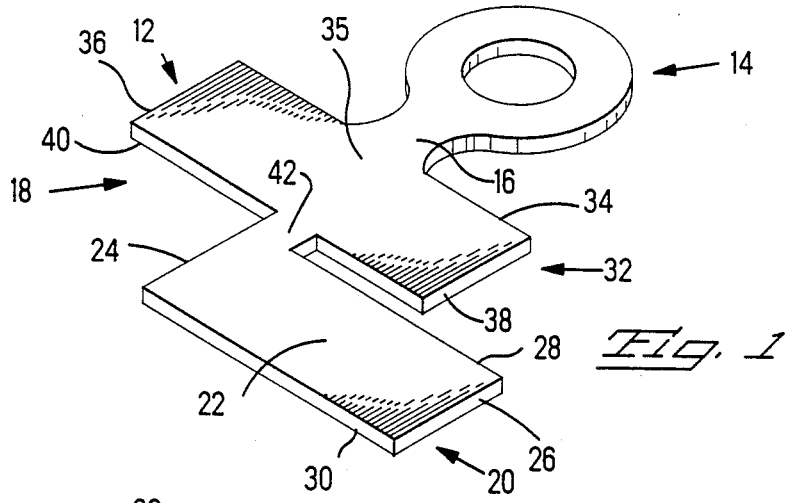
FIG. 1 is a flat plan view of a terminal blank used in making a terminal in accordance with the invention.
Figure 2:
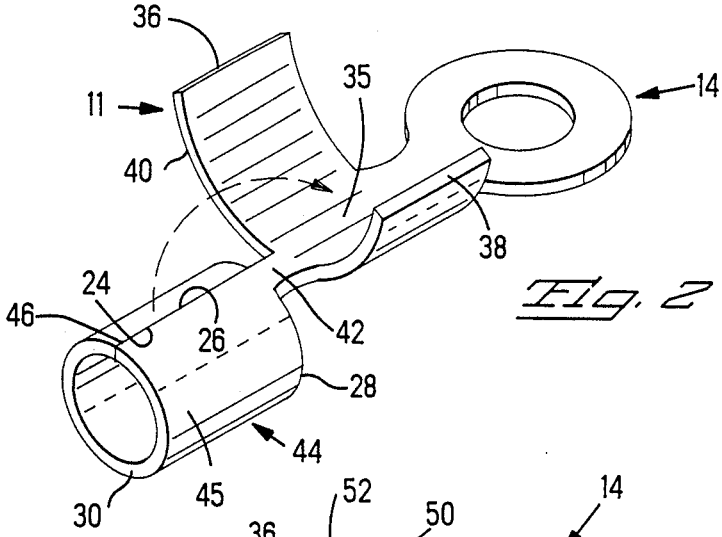
FIG. 2 is a perspective view of a partially formed terminal made from the blank of FIG. 1.
Figure 3:
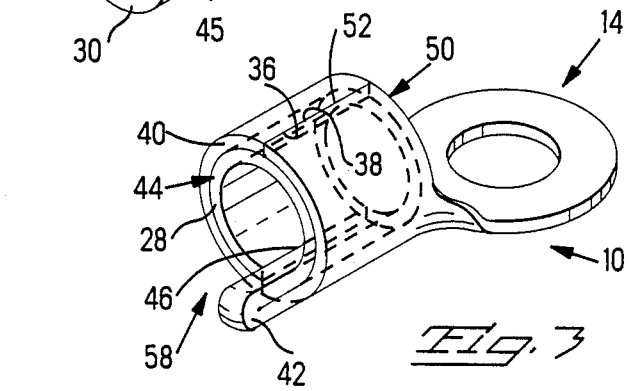
FIG. 3 is a perspective view of the terminal formed from the blank of FIG. 1.

Referring now to FIGS. 1 through 3, which illustrate the steps in making electrical terminal 10 shown in FIG. 3. FIG. 1 shows the terminal blank 12 having a forward portion 14 adapted to be formed into at least one contact section, an intermediate portion 16 and a rearward portion 18 adapted to be formed into first and second barrel sections 20, 32. For purposes of illustrating the invention, forward portion 14 of terminal blank 12 is shown as a ring terminal. It is to be understood that the contact section made from portion 14 may have a different number of configurations, such as a blade member, a ring tongue, spade lug or a formed member, such as a wave shaped washer as disclosed in U.S. patent application Ser. No. 07/359,240 filed concomitantly herewith entitled "Electrical Terminal with Annular Section."

First and second barrel sections 20, 32 of rearward portion 18 are initially rectangular plates 22, 34. First barrel section 20 opposed lateral edges 24, 26 and opposed forward and rearward edges 28, 30 and is joined integrally with and extends rearwardly from rearward edge 40 of second barrel section 32 at a bight section 42. Second barrel section has opposed lateral edges 36, 38 and a rearward edge 40. Second barrel section 32 is joined integrally with and extends rearwardly from the intermediate portion 16. In the embodiment shown in FIGS. 1 through 3, first barrel section 20 is substantially offset from second barrel section 32.

FIG. 2 illustrates a partially formed terminal 11 in which first barrel section 20 has been formed into a barrel shaped member 44 having the lateral edges 24, 26 thereof abutting at a first seam 46. As indicated by the arrow, barrel shaped member 44 is to be disposed along an adjacent major surface 35 of the second barrel section 32 by bending a bight section 42 such that first seam 46 is disposed intermediate lateral edges 36, 38 of the second barrel section 32. Second barrel section 32 is then formed into an outer barrel member 50 to extend circumferentially around an adjacent outer surface 45 of the barrel shaped member 44. Lateral edges 36, 38 of second barrel section 32 abut at a second seam 52 which is essentially diametrically opposed from the first seam 46. As can be seen from FIG. 3, a continuous portion of the outer barrel member 50 overlies first seam 46 of the barrel shaped member 44 and continuous portion of barrel shaped member 44 underlies second seam 52. By positioning the seams 46, 52 on opposite sides of the assembled barrel portion terminal 10, the double barrel portion 58 functions essentially as a solid barrel when it is crimped.

Figure 5:
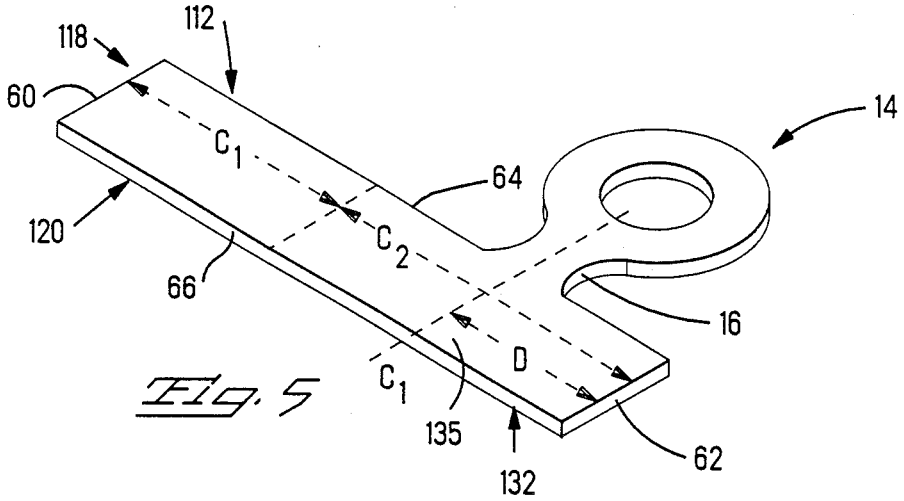
FIG. 5 is a flat plan view of an alternative embodiment of a terminal blank made in accordance with the invention.
Figure 6:
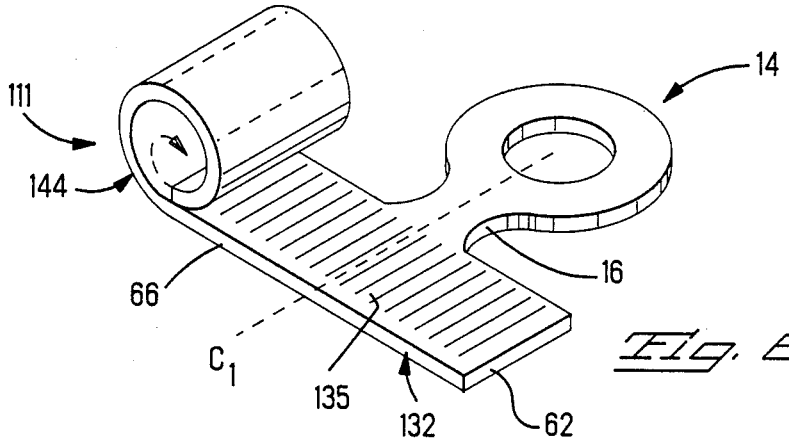
FIG. 6 is a perspective view of a partially formed terminal made from the blank of FIG. 5.
Figure 7:
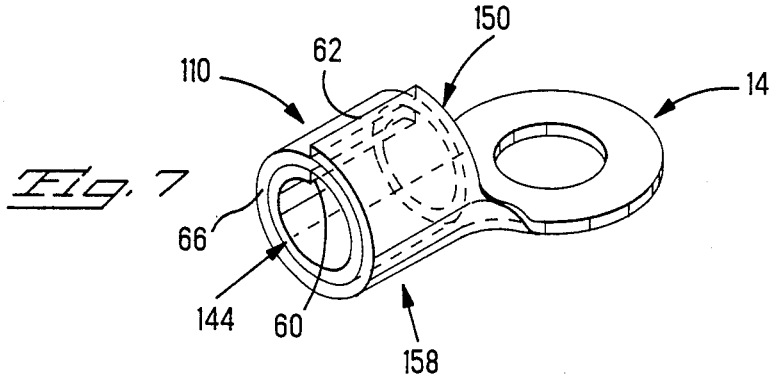
FIG. 7 is a perspective view of the formed terminal made from the blank of FIG. 5.

FIGS. 5 through 7 illustrate the steps in forming the alternative embodiment 110 shown in FIG. 7. The terminal blank 112 as shown in FIG. 5 comprises a forward portion 14 adapted to be formed into at least one contact section, an intermediate portion 16 extending rearwardly from said forward portion 14 and a rearward portion 118 adapted to be formed into first and second barrel sections 120 and 132. Rearward portion 118 is essentially a long rectangular plate having opposed lateral edges 60, 62 and opposed forward and rearward edges 64, 66. The length of the rectangular rearward portion 118 is approximately two times the intended circumference of the wire-receiving barrel to be formed. Rearward portion 118 is integrally joined with and extends rearwardly from intermediate portion 16 at a location along forward edge 64 of portion 118 a distance D essentially equal to one-half of the intended outer barrel circumference.

Figure 8:
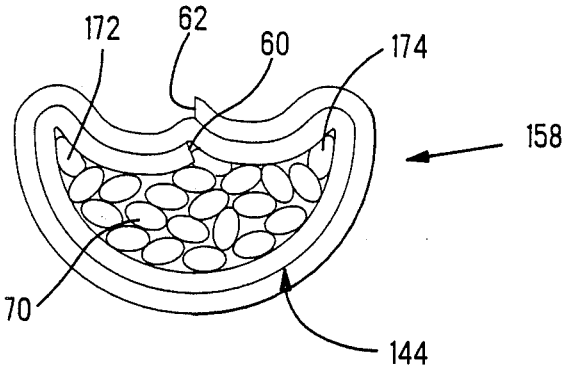
FIG. 8 is a fragmentary cross sectional view illustrating the conductor terminated in the barrel portion of the terminal of FIG. 7.

Rearward portion 118 includes first and second barrel portions 120 and 132, extending continuously therealong with first barrel portion 120 extending from lateral edge 60 a distance equal to the length of the intended inner circumference $C_1$ of the inner barrel portion and a second portion 132 extending along 118 or a distance equal to the length of the intended outer circumference $C_2$ of the outer barrel. FIG. 6 shows the partially formed terminal 111 in which the first barrel portion 120 has been formed by continuously rolling the first rearward portion into a spiral barrel-shaped member 144 having the intended interior diameter. As indicated by the arrow, first barrel-shaped member 144 portion is to be rolled along the surface of elongated member 118 until lateral edge 60 lies approximately at the axial center line $C_L$ through forward portion 14 and second barrel portion 132 of the terminal 110 as best seen in FIG. 7. Forming of the terminal 110 of FIG. 8 is completed by rolling the remaining portion of the second or outer barrel member 132 around the circumference of the barrel shaped member 144 such that lateral edge 62 lies approximate the center line of terminal 110 as best seen in FIG. 7. In the spiral wire-receiving barrel member of terminal 110, lateral edges 60 and 62 lie essentially over each other with a continuous strip of metal disposed therebetween.

Figure 4:
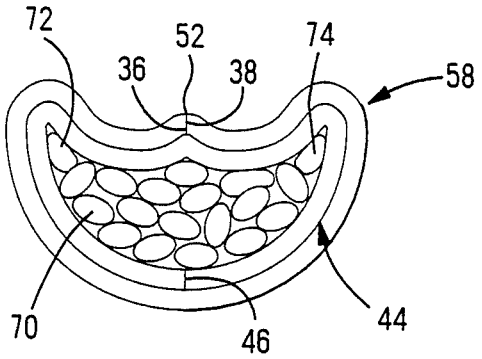
FIG. 4 is a fragmentary cross sectional view illustrating the conductor terminated in the barrel portion of the terminal of FIG. 3.

FIGS. 4 and 8 show the termination of conductor wire 70 in the double barrel members 58, 158 respectively. Upon applying crimping force to double barrel member 58, of FIG. 4, the inner solid barrel portion of barrel shaped member 44 and the corresponding ends 36, 38 along seam 52 of outer barrel member 50 are pressed downwardly such that the inner barrel portion is subjected to sufficient plastic deformation that it resists springing back to its original shape. Plastic deformation in the continuous inner barrel-shaped member 44 resists outward movement and essential eliminates force directly outwardly against the abutting lateral edges 36 and 38 of the outer barrel member 50. Upon applying crimping force to spiral barrel member 158, as shown in FIG. 8, the inner solid barrel portion of barrel-shaped member 144 and the corresponding lateral edges 60, 62 of spiral barrel 158 are pressed downwardly such that the inner barrel portion is subjected to sufficient plastic deformation that it resists springing back to its original shape. Plastic deformation in the continuous inner barrel-shaped member resists outward movement and essentially eliminates force directly outwardly against the lateral edges 60 and 62 of the spiral barrel member 158.

The crimp shown in FIGS. 4 and 8 is disclosed in previously discussed U.S. Pat. No. 2,535,013. As can be seen in both FIG. 4 and 8, the center of the crimped section and the center portion of the crimp are plastically deformed preferably below the horizontal axis of barrels 58, 158 whereby the wire strands are forced into two sections 72, 172 and 74, 174 forming a "B" shape. The crimping force causes cold welding to occur between the internal surface of the first inner wire barrel portions and wire strands which further aid in retaining the wire barrel in its crimped position.

The terminal of the present invention may be used with a wide variety of wire sizes. In accordance with the present invention, it is also preferable that the seam of the outer barrel 50 of FIG. 4 or the edge 62 of outer barrel 150 of FIG. 6 be aligned essentially at the center of the crimped area to maximize cold welding along the line. To assure good engagement between the respective barrel surfaces, it is preferable to put a plurality of serrations on at least one of the surfaces of the barrel portions that are engagement with each other as shown in FIGS. 2 and 6. Preferably the serrations run axially on surface 35, 135 of the barrel portion 32, 132 respectively or on the outer surface of the first barrel portion 20, 120 respectively. In addition, serrations can also be placed on the inner surface of first barrel portion 20, 120 to assure better cold welding of the wire strands in the respective barrel shaped members 44, 144. A number of materials can be used for making contacts of this type. Preferably the material used has a high conductivity but a low stress relaxation so that a crimp will remain closed over the lifetime of the contact.

The present invention provides a crimpable barrel type terminal member that may be used for power or signal connections. The electrical contact terminal as disclosed herein and shown in the accompanying Figures, provides a terminal that can be manufactured in a cost effective stamped and formed manner and permits the use of many grades of materials and combinations of materials so long as the selected material gives the desired amount of conductivity needed for low termination resistance and has the proper mechanical properties to minimize stress relaxation. The double layer barrel portion adds bulk to the barrel thus permitting crimping in a manner that is equivalent to crimping a continuous annular barrel member without the need for welding or brazing and gives a stable crimp with a minimum of constriction resistance.

It is thought that the electrical contact terminal of the present invention many of its intended advantages will be understood from the foregoing description. Changes may be made in the form, construction and arrangement of parts thereof without departing from the spirit and scope of the invention or sacrificing all of its material advantages.

We claim:

1. A method for making a wire-receiving barrel terminal having a barrel with a desired inner diameter, comprising the steps of:

selecting a metal stock having the desired properties;

stamping a terminal blank having a forward portion adapted to be formed into at least one contact section, an intermediate portion extending rearwardly from said forward portion, and a rearward portion adapted to be formed into first and second barrel sections, said second barrel section of said rearward portion being joined integrally with and extending rearwardly from said intermediate portion and said first barrel section being joined integrally with and extending from said second barrel section, said first and second barrel sections being generally rectangular, each having at least one lateral edge and a respective lateral dimension at least equal to the circumference of a circle of said desired wire-receiving barrel inner diameter;

forming said first barrel section into a barrel-shaped member having its axis parallel to said at least one lateral edge of said first barrel section; and forming said second barrel section circumferentially around and adjacent said first barrel section, thus defining a wire receiving barrel having inner and outer walls, said at least one lateral edge of said first and second barrel sections being located along a continuous wall portion of said second and first barrel sections, respectively; whereby the resulting wire-receiving barrel has substantially two wall thicknesses circumferentially therearound and no open seam.

2. A wire receiving barrel terminal made in accordance with the method of claim 1.

3. A method for making a wire barrel terminal comprising the steps of:

selecting a metal stock having the desired properties;

stamping a terminal blank having a forward portion adapted to be formed into at least one contact section, an intermediate portion extending rearwardly from said forward portion and a rearward portion adapted to be formed into first and second barrel sections, said second barrel section of said rearward portion initially being a rectangular plate having opposed lateral edges and a rearward edge and being joined integrally with and extending rearwardly from said intermediate portion and said first barrel section initially being a rectangular plate having opposed lateral edges and opposed forward and rearward edges and being joined integrally with and extending rearwardly from said rearward edge of said second barrel section at a bight section, said first barrel section being substantially offset from said second barrel section;

forming said first barrel section into a barrel-shaped member having said lateral edges thereof abutting at a first seam;

disposing said barrel shaped member along an adjacent major surface of said second barrel section by bending at said bight section such that said first seam is disposed intermediate said lateral edges of said barrel section; and forming said second barrel section member into an outer barrel member to extend circumferentially around said adjacent outer surface of said barrel shaped member and having said lateral edges thereof abutting at a second seam essentially diametrically opposed from said first seam and a continuous portion of the outer barrel member overlies said first seam of said barrel shaped member.

4. The method for making a wire barrel terminal as defined in claim 3 further comprising the step of partially forming said second barrel section into a U-shaped member, the U-shape thereof extending rearwardly from said intermediate portion prior to disposing said barrel shaped member adjacent said major surface of said second barrel section.

5. A wire receiving barrel terminal made in accordance with the method of claim 3.

6. A wire-receiving barrel terminal having a barrel with a continuous wall extending circumferentially at least 720° from a first free end to a second free end, defining a barrel having essentially two wall thicknesses at every angular location therearound and at least one wall circumferentially continuous at any angular location.

* * * * *

UNITED STATES PATENT AND TRADEMARK OFFICE

CERTIFICATE OF CORRECTION

PATENT NO. : 4,951,389

DATED : August 28, 1990

INVENTOR(S) : Robert C. Kaley, et al

It is certified that error appears in the above-identified patent and that said Letters Patent is hereby corrected as shown below:

Title page, In the abstract, line 21, "5" should be --50--.

Signed and Sealed this

Third Day of December, 1991

*Attest:*

HARRY F. MANBECK, JR.

*Attesting Officer*

*Commissioner of Patents and Trademarks*